United States Patent [19]

Sass

[11] Patent Number: 4,552,989

[45] Date of Patent: Nov. 12, 1985

[54] MINIATURE COAXIAL CONDUCTOR PAIR AND MULTI-CONDUCTOR CABLE INCORPORATING SAME

[75] Inventor: Richard G. Sass, Portland, Oreg.

[73] Assignee: National Electric Control Company, Portland, Oreg.

[21] Appl. No.: 634,316

[22] Filed: Jul. 24, 1984

[51] Int. Cl.[4] ..... H01B 11/00

[52] U.S. Cl. ..... 174/103; 174/107; 174/108; 174/109

[58] Field of Search ..... 174/102 R, 103, 107, 174/108, 110 PM, 110 FC

[56] References Cited

U.S. PATENT DOCUMENTS

| | | | |
|---|---|---|---|
| 2,163,235 | 6/1939 | Chatham | 174/107 |
| 2,636,923 | 4/1953 | Perzel | 174/28 |
| 2,754,350 | 7/1956 | Hurd | 174/102 R |
| 3,629,941 | 12/1971 | Wagele | 174/102 R X |
| 3,651,243 | 3/1972 | Hornor et al. | 174/103 X |
| 3,790,697 | 2/1974 | Buckingham | 174/108 X |
| 4,010,619 | 3/1977 | Hightower et al. | 174/110 FC X |
| 4,029,889 | 6/1977 | Mizuochi | 174/110 FC X |
| 4,104,481 | 8/1978 | Wilkenloh et al. | 174/110 PM X |
| 4,246,435 | 1/1981 | Thompson | 174/107 X |
| 4,322,574 | 3/1982 | Bow et al. | 174/107 |
| 4,332,976 | 6/1982 | Hawkins | 174/107 |
| 4,340,773 | 7/1982 | Perreault | 174/107 |
| 4,358,636 | 11/1982 | Ijff et al. | 174/103 |
| 4,440,973 | 4/1984 | Hawkins | 174/36 |
| 4,487,991 | 12/1984 | Forsyth et al. | 174/110 PM |

*Primary Examiner*—A. C. Prescott
*Assistant Examiner*—Morris H. Nimmo
*Attorney, Agent, or Firm*—Chernoff, Vilhauer, McClung, Birdwell & Stenzel

[57] ABSTRACT

A multi-conductor cable including a plurality of miniature coaxial conductor pairs, each including an inner conductor supported by a very thin tubular layer of solid, relatively stiff dielectic material, surrounded by a much thicker wrapping of dielectric tape having a lower dielectric constant than that of the tubular layer. An outer conductor of multiple strands of wire is helically laid about the dielectric tape wrapping. The tubular layer provides mechanical support for each inner conductor, protecting against breakage due to bending of the individual conductor strands, without significantly increasing either the capacitance or diameter of the coaxial conductor pairs.

12 Claims, 5 Drawing Figures

(CABLE)

(COAX PAIR)

(CABLE)

(COAX PAIR)

(ALTERNATIVE COAX PAIR)

MINIATURE COAXIAL CONDUCTOR PAIR AND MULTI-CONDUCTOR CABLE INCORPORATING SAME

BACKGROUND OF THE INVENTION

The present invention relates to multi-conductor cables, and particularly to the structure of a miniature coaxial conductor pair for use in such cables.

Cables including numerous pairs of coaxial conductors for interconnecting elements of computer and other electronic systems must be small in size and highly flexible to enable their use in such systems. In order to keep the volume of such cable to a minimum, the coaxial conductor pairs inside the cable must accordingly be of extremely small diameter. Despite their small size, however, the coaxial conductor pairs must be highly resistant to breakage due to the flexing of the cable, while also having the ability to transmit signals rapidly with immunity from interference or leakage of signals between individual conductors.

The prevention of interference or leakage between such coaxial conductors during rapid signal transmission requires a high degree of electrical insulation between the conductors, which has led to the requirement of minimizing the dielectric constant of the insulation material to produce a coaxial conductor structure of the lowest possible capacitance per unit length. Minimizing of the capacitance between a pair of coaxial conductors maximizes the practical velocity of propagation of signals through the conductors, without which the speed of the overall system is inhibited and problems in synchronization among elements thereof may result.

It is known that insulating material of a low dielectric constant composed of polymeric fluorocarbon materials in various woven filament or wrapped tape configurations, such as those disclosed in Hawkins U.S. Pat. Nos. 4,332,976 and 4,440,973, and Perrault U.S. Pat. No. 4,340,773, enables signal propagation velocities of approximately 80% of the speed of light even though the thickness of the insulation is relatively small. In other known coaxial conductor pairs, the inner conductor is insulated from the outer conductor with a helical wrapping of tape composed of an expanded fibrous polytetrafluoroethylene (PTFE), which includes entrapped air in the material itself producing an even lower dielectric constant.

While the velocity of propagation achieved with such previously-available coaxial conductor pairs is excellent, the use of the insulating material in the form of woven filaments or tape in contact with the inner conductor of the coaxial pair has provided too little mechanical support for the inner conductor to prevent an unacceptably high rate of breakage of the inner conductor due to normal flexure of the cable. Accordingly many of these coaxial conductors have been susceptible to breakage of the conductors within short periods of time.

It is known to enclose an inner conductor of a coaxial conductor pair in an extruded solid insulation tubing of PTFE or other suitable material as shown, for example, in Perzel U.S. Pat. No. 2,636,923. Although such structure offers better mechanical support for the inner conductor, tubular solid PTFE or similar material does not have as low a dielectric constant as does a tape or filament structure of the same material, especially an expanded or fibrous tape or filament, and therefore a higher capacitance and lower velocity of signal propagation must be tolerated unless additional insulation is provided in some other way which adds diameter and complexity to the coaxial structure.

Accordingly, what is needed is a miniature coaxial conductor construction for use in a multi-conductor cable which withstands flexure for a significantly longer time than previous constructions without breakage of the inner conductor, has a high degree of flexibility despite its resistance to breakage, is extremely small in diameter to minimize the size of the multi-conductor cable in which it is incorporated and yet, despite its small size, has a low capacitance and corresponding high velocity of signal propagation.

SUMMARY OF THE INVENTION

The present invention provides a highly flexible multi-conductor cable incorporating multiple coaxial conductor pairs whose construction provides a greatly improved resistance to breakage of the individual conductors without any significant loss in velocity of propagation of signals through the individual coaxial conductor pairs or any significant increase in diameter thereof as compared to previous constructions.

In the unique design of each coaxial conductor pair employed in the present invention, an inner conductor preferably composed of high-strength copper alloy wire, soft drawn and fully annealed, is surrounded by an extruded solid tube of relatively stiff dielectric material such as a polymeric fluorocarbon or high density polyethylene which is in physical contact with the exterior surface of the inner conductor. Such tubular layer is much stiffer and harder than polyvinylchloride (PVC) insulating material which is commonly used to insulate conductors in many applications, and because of this stiffness a very thin-walled tube, having a radial thickness on the order of only 10% to 40% of the diameter of the inner conductor, is sufficient to provide mechanical support opposing short-radius bending of the inner conductor of each coaxial pair.

Surrounding the tubular layer is an insulation wrapping having a considerably larger radial thickness than that of the tubular layer (on the order of four to six times the radial thickness of the tubular layer). The wrapping is of a dielectric filament or tape material (hereinafter generically referred to as "tape"), such as an expanded or fibrous polymeric fluorocarbon tape which includes air spaces within the tape as well as trapped within the wrapping layers, providing a lower dielectric constant than that of the extruded solid tubular layer. The thinness of the extruded tubular material relative to the thickness of the surrounding wrapping is important to minimizing the capacitance of the coaxial conductor pair while also minimizing its diameter, as explained more fully hereafter.

Surrounding the wrapping is the outer conductor composed of a plurality of strands of wire preferably, but not necessarily, wrapped helically parallel to one another.

Covering the outer conductor is a wrapped, dielectric, friction-resistant film preferably, but not necessarily, composed of one of the polyethylene terephthalates (PET) known under the trademarks Mylar or Halar. This outer film performs the dual functions of providing a low coefficient of friction between adjacent coaxial conductor pairs within a cable to enhance flexibility of the cable, and also providing dielectric isolation between the adjacent outer conductors of the several coaxial conductor pairs to prevent interference among them, which can otherwise occur to some extent even though all of the outer conductors may, nominally, be at a single ground potential.

Multiple coaxial conductor pairs of the abovedescribed design may be incorporated as a bundle in any flexible multi-conductor cable construction but, preferably, are arranged in a helical bundle wrapped with a sheath of the aforementioned PET film material, over which a shield of braided wire may extend surrounding the sheath. An outer cover of a tough material, yet more resilient than the aforementioned tubular layer, such as polyvinylchloride (PVC) provides additional support, accompanied by flexibility. The resultant cable is both flexible and resistant to breakage due to flexure of the individual conductors, primarily because of the physical support provided by the extruded tubular layer for each of the individual inner conductors of the coaxial pairs. Flexibility is aided by the capability of the individual coaxial conductor pairs to move relative to one another with a low amount of frictional resistance due to their PET outer films.

In another embodiment of the coaxial conductor construction, a second thin tubular layer of extruded solid material as described above may be interposed between the aforementioned wrapping of dielectric filament or tape and the outer conductor of each of the individual coaxial conductor pairs, providing additional mechanical support and stiffening for the coaxial conductor pair and especially for the outer conductor. The radial thickness of this outer tubular layer is also very small by comparison with the radial thickness of the wrapping of lesser dielectric constant, so that the combined thickness of the inner tubular layer and the outer tubular layer is significantly smaller than the radial thickness of the wrapping (on the order of $\frac{1}{3}$ to $\frac{1}{2}$ of the wrapping thickness).

The individual coaxial conductor pairs constructed according to the present invention not only have a high resistance to breakage, but also have a velocity of propagation on the order of 79% to 80% of the speed of light without necessitating an enlarged diameter to accommodate the solid tubular support material. This compares favorably to the low capacitance and high velocity of propagation of even the best of the previously known miniature coaxial conductor pairs which use solely expanded or fibrous dielectric tape insulating material of the lowest dielectric constant while sacrificing mechanical support. The present invention can achieve the seemingly inconsistent results of comparably low capacitance and small diameter despite the presence of the extruded solid tubular supporting material because of two principal facts. First, the extruded solid tubular material has a dielectric constant which, although nominally $\frac{1}{3}$ to $\frac{1}{2}$ greater than that of the aforementioned tape insulating material, is actually not that much greater when compression due to wrapping of the tape material is taken into account. Second, the tubular material is sufficiently stiff to be able to accomplish its supporting function in a thin-walled form occupying only a minor portion of the volume of insulating material interposed between the conductors of each coaxial conductor pair.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
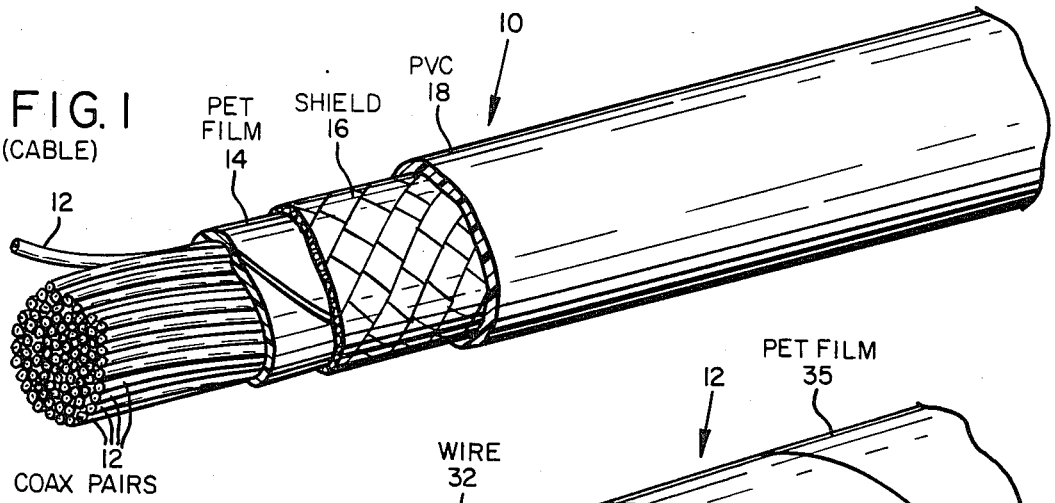
FIG. 1 is a perspective view of a segment of an exemplary multi-conductor cable including a bundle of coaxial conductor pairs in accordance with the present invention, with the various layers shown cut away to different distances.
Figure 2:
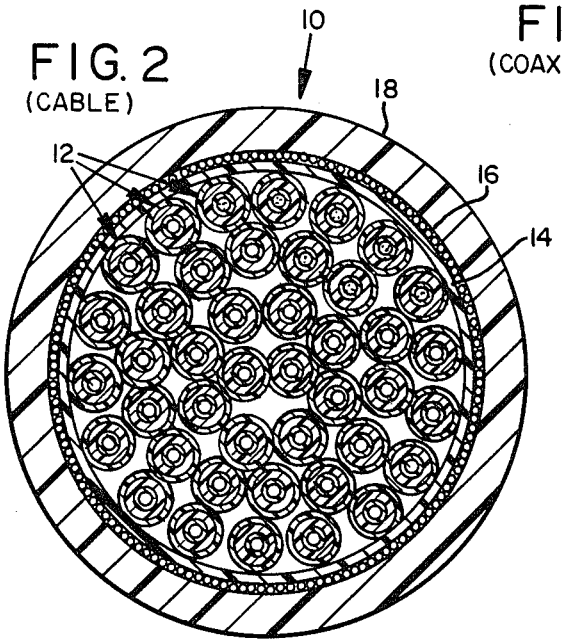
FIG. 2 is a cross section of the cable shown in FIG. 1.

Referring to FIGS. 1 and 2, an exemplary multi-conductor cable 10 includes a bundle of helically laid coaxial conductor pairs 12 of either uniform or non-uniform diameter as desired. A thin sheath 14 of PET film material, for example $\frac{1}{2}$ mil Mylar tape, is wrapped helically around the circumference of the bundle of coaxial conductors 12 with a 50% lap. A shield layer 16 of braided fine wire such as 40 AWG surrounds the film material, preferably providing at least 85% coverage. An outer cover layer 18 is of medical grade polyvinylchloride of a radial thickness of about 0.045 inches.

The PET sheathe 14 has a low coefficient of friction to enhance flexibility of the cable 10, and provides electrical isolation of the coaxial conductor pairs 12 from the shield layer 16. The shield 16 provides electrical shielding for the entire bundle of coaxial conductors 12, and also provides mechanical support to hold the coaxial conductor pairs 12 properly aligned with one another, despite flexure of the multi-conductor cable 10. The cover layer 18, being of more pliable material than the shield 16, protects the exterior of the shield while permitting it and the coaxial conductor pairs 12 to flex easily a required in the utilization of the cable 10.

Figure 3:
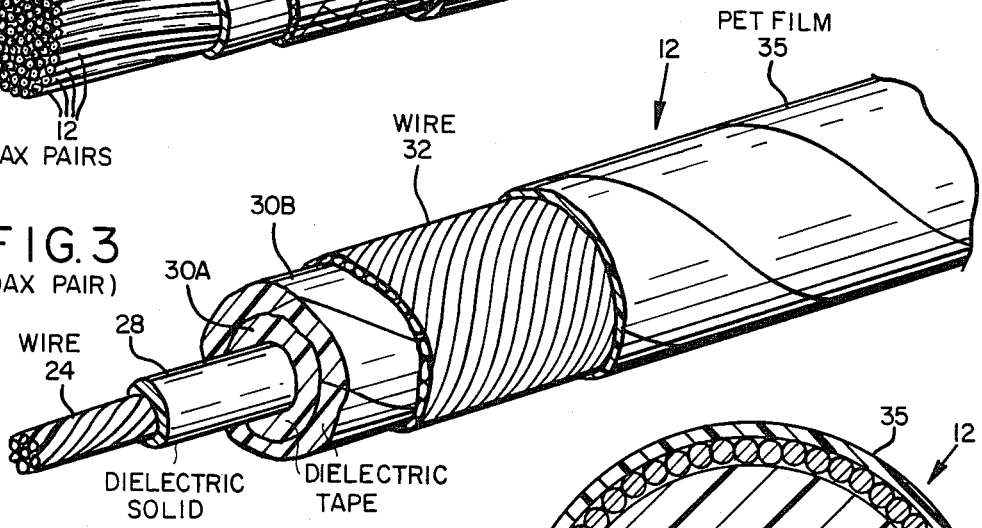
FIG. 3 is a perspective view of one of the coaxial conductor pairs of the cable of FIG. 1, showing the various layers of the coaxial structure and its dielectric system cut away to different distances.
Figure 4:
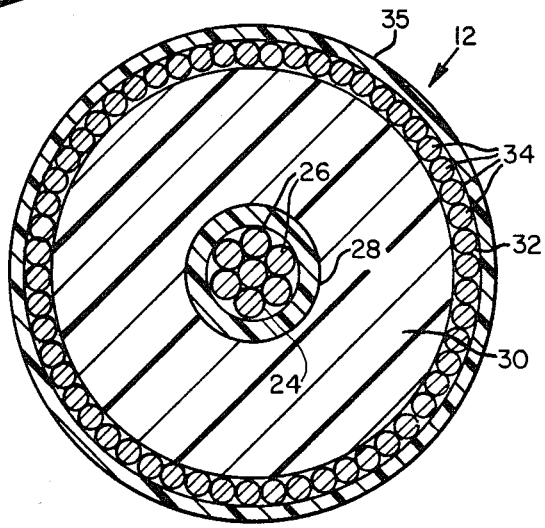
FIG. 4 is a cross section of the coaxial conductor pair shown in FIG. 3.

Referring now to FIGS. 3 and 4, a single one of the exemplary coaxial conductor pairs 12 is seen to include an inner conductor 24 which may be a helically-laid group of individual strands of fine wire, preferably of copper such as soft drawn, fully annealed alloy 135 copper wire because of its superior strength. The inner conductor 24 may, for example, consist of seven individual strands 26 of 42 AWG helically wound wire as best seen in FIG. 4.

The dielectric system of the conductor pair 12 includes a tubular first layer 28 of a solid extruded polymeric fluorocarbon or high density polyethylene having a dielectric constant of approximately between 2 and 3 and a radial thickness of about 0.002 inches. For example, the tubular layer 28 may be of Dupont Teflon brand PTFE extruded in place around the inner conductor 24 and in physical contact therewith. The tubular layer 28 provides the primary mechanical support for resisting small-radius bending and breaking of the individual strands 26 of the inner conductor 24.

A second layer of the dielectric system of the coaxial conductor pair 12 is a wrapping 30 of a tape having a lower dielectric constant than that of the solid tubular layer 28. The wrapping may, for example, be an expanded PTFE tape manufactured as disclosed in U.S. Pat. Nos. 3,953,566 and 4,187,390, which are incorporated herein by reference, or a fibrous polymeric fluorocarbon tape manufactured by Chemplast of Wayne, N.J., a division of the Norton Corporation of Worcester, Mass., under the trademark ZITEX. Alternatively, the wrapping 30 may be of any other tape material having a dielectric constant less than 2 when in an uncompressed condition. Preferably, a first layer of tape 30A having a $\frac{1}{8}$ inch width and a thickness of 4 mils is helically wrapped around the tubular inner layer 28 with approximately a 10% lap, surrounded by a second layer 30B of the same dimensions, also wrapped helically with approximately a 10% lap. Preferably, the wrapping 30 has its helical wraps twisting oppositely to the helices of the strands 26 of the central conductor.

Laid helically around the wrapping 30 is an outer conductor 32 which may, for example, be of 42 AWG wire wrapped helically in a single layer of strands 34 surrounding the wrapping 30 and compressing it somewhat to a radial thickness of approximately 0.010 inch. The expanded or fibrous tape material of which the wrapping 30 is made contains a considerable amount of air dispersed between fibers of the material so as to provide a better dielectric, with the dielectric constant of the material being decreased to about 1.3–1.5 by the presence of the air between the fibers. However, the compression of the material by the outer conductor 32 removes some of the air and therefore increases the dielectric constant.

Covering the outer conductor 32 is a layer of PET film material 35 or other friction-resistant dielectric material having a thickness, for example, of $\frac{1}{2}$ mil wrapped with a 50% lap to provide a total thickness of 1 mil. This layer provides a low coefficient of friction to permit the several coaxial conductor pairs 12 to move relative to one another without undue resistance during flexure of the cable 10, and also provides dielectric insulation between the adjacent outer conductors of the several coaxial conductors 12.

Figure 5:
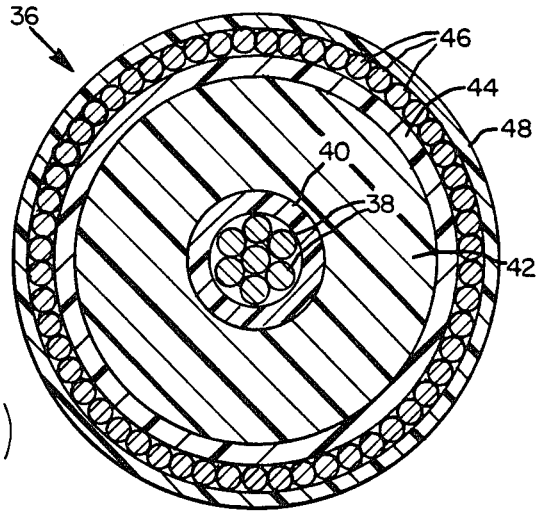
FIG. 5 is a cross section of an alternative embodiment of a coaxial conductor pair in accordance with the present invention.

Referring now to FIG. 5, a coaxial conductor pair 36 which is a alternative embodiment of the present invention includes an inner conductor 38 similar to the inner conductor 24, a tubular, solid, extruded dielectric layer 40 similar to the tubular layer 28, and a wrapping 42 of dielectric material similar to the wrapping 30. Surrounding the wrapping 42, however, is an additional solid tubular layer 44 of the aforementioned extruded material covering the wrapping 42 with a radial thickness of about 0.002 inch. Preferably, the diameter of the exterior surface of the tubular layer 44 is no greater than the diameter of the exterior surface of the wrapping 30 in the coaxial conductor pair 12, so that the same small size is retained. Helically wrapped about the tubular layer 44 in physical contact therewith is an outer conductor 46 similar to outer conductor 32 and a PET film 48 similar to film 35. The additional tubular layer 44 provides additional mechanical support, especially for the outer conductor 46, without adding significantly to the diameter or capacitance of the coaxial conductor pair.

The terms and expressions which have been employed in the foregoing specification are used therein as terms of description and not of limitations, and there is no intention, in the use of such terms and expressions, of excluding equivalents of the features shown and described or portions thereof, it being recognized that the scope of the invention is defined and limited only by the claims which follow.

What is claimed is:

1. A coaxial conductor pair, comprising:

(a) an inner electrical conductor:

(b) a dielectric system comprising (i) a tubular layer of substantially solid dielectric material, selected from the group consisting essentially of polymeric fluorocarbon, high density polyethylene and mixtures thereof, surrounding said inner conductor in physical contact therewith, and (ii) a wrapping of dielectric tape material, surrounding said tubular layer and having a dielectric constant less than 2 and a radial thickness greater than that of said tubular layer; and (c) an outer electrical conductor surrounding said dielectric system.

2. The coaxial conductor pair of claim 1 wherein said dielectric tape material is composed of expanded polymeric fluorocarbon.

3. The coaxial conductor pair of claim 1, further including a dielectric, friction-resistant film surrounding said outer electrical conductor.

4. The coaxial conductor pair of claim 2 wherein said film is composed of a polyethylene terephthalate.

5. The coaxial conductor pair of claim 1 wherein said tubular layer has a radial thickness no greater than 40% of the thickness of said inner electrical conductor.

6. The coaxial conductor pair of claim 1 wherein said wrapping has a radial thickness at least four times the radial thickness of said tubular layer.

7. The coaxial conductor pair of claim 1, said dielectric system further comprising a second tublar layer of substantially solid dielectric material, selected from the group consisting essentially of polymeric fluorocarbon, high density polyethylene and mixtures thereof, interposed between said wrapping and said outer electrical conductor.

8. The coaxial conductor pair of claim 7 wherein said wrapping has a radial thickness greater than that of said second tubular layer.

9. A flexible multi-conductor cable, comprising:

(a) a plurality of coaxial conductor pairs, each said coaxial conductor pair having (i) an inner electrical conductor;

(ii) a dielectric system including a tubular layer of substantially solid dielectric material, selected from the group consisting essentially of polymeric fluorocarbon, high density polyethylene and mixtures thereof, surrounding said inner conductor in physical contact therewith, and a wrapping of dielectric tape material, surrounding said tubular layer and having a dielectric constant less than 2 and a radial thickness greater than that of said tubular layer;

(iii) an outer electrical conductor surrounding said dielectric system; and (iv) a dielectric, friction-resistant film wrapping surrounding said outer electrical conductor; and (b) a tublar cover layer of dielectric material surrounding all of said plurality of coaxial conductor pairs.

10. The flexible cable of claim 9 wherein said coaxial conductor pairs are laid helically within said cover layer.

11. The flexible cable of claim 9, further comprising a sheath of dielectric friction-resistant film surrounding all of said plurality of coaxial conductor pairs, within said cover layer, and an electrically conductive shield layer interposed between said sheath of dielectric friction resistant film and said cover layer.

12. The coaxial conductor pair of claim 1 wherein said dielectric tape material is of fibrous polymeric fluorocarbon.

* * * * *

UNITED STATES PATENT AND TRADEMARK OFFICE

CERTIFICATE OF CORRECTION

PATENT NO. : 4,552,989

DATED : November 12, 1985

INVENTOR(S) : Richard G. Sass

It is certified that error appears in the above-identified patent and that said Letters Patent is hereby corrected as shown below:

In the Abstract, line 4 Change "dielectic" to --dielectric--.

Col. 4, line 44 Change "a" to --as--.

Col. 5, line 40 Change "a" to --an--.

Col. 6, line 1 Change "conductor:" to --conductor;--.

Col. 6, line 28 Change "tublar" to --tubular--.

Signed and Sealed this

*Fourth* Day of *February 1986*

[SEAL]

*Attest:*

DONALD J. QUIGG

*Attesting Officer*

*Commissioner of Patents and Trademarks*